US008905164B1

(12) United States Patent
Capouellez et al.

(10) Patent No.: US 8,905,164 B1
(45) Date of Patent: Dec. 9, 2014

(54) VEHICLE WITH SACRIFICIAL UNDERBODY STRUCTURE

(71) Applicants: James A. Capouellez, Lake Orion, MI (US); Bijan Khatib-Shahidi, Novi, MI (US); Leo J. Greene, New Hill, NC (US)

(72) Inventors: James A. Capouellez, Lake Orion, MI (US); Bijan Khatib-Shahidi, Novi, MI (US); Leo J. Greene, New Hill, NC (US)

(73) Assignee: US Government as Represented by the Secretary of the Army, Washington, DC (US)

( * ) Notice: Subject to any disclaimer, the term of this patent is extended or adjusted under 35 U.S.C. 154(b) by 127 days.

(21) Appl. No.: 13/847,754

(22) Filed: Mar. 20, 2013

(51) Int. Cl.
*B62D 55/06* (2006.01)
*F41H 7/04* (2006.01)

(52) U.S. Cl.
CPC ..... *F41H 7/042* (2013.01)
USPC ..... 180/9.1; 89/36.08

(58) Field of Classification Search
USPC ..... 89/36.08, 36.09; 180/9.1
See application file for complete search history.

(56) References Cited

U.S. PATENT DOCUMENTS 5,564,984 A 10/1996 Mirabella et al.
5,947,520 A 9/1999 McHorse
6,626,712 B1 * 9/2003 Bellezza Quater et al. ..... 440/12.56
7,997,182 B1 8/2011 Cox
8,640,594 B2 * 2/2014 Treadway et al. ..... 89/36.08
8,826,795 B2 * 9/2014 Capouellez ..... 89/36.08
2003/0010189 A1 * 1/2003 Zonak ..... 89/36.08
2008/0173167 A1 * 7/2008 Mills et al. ..... 89/36.02
2011/0079978 A1 4/2011 Schreiner et al.
2011/0138994 A1 * 6/2011 Joynt et al. ..... 89/36.08
2012/0186428 A1 * 7/2012 Peer et al. ..... 89/36.02
2013/0220108 A1 * 8/2013 Oriet ..... 89/36.08

* cited by examiner

*Primary Examiner* — Tony Winner
(74) *Attorney, Agent, or Firm* — David L. Kuhn; Thomas W. Saur; Luis Miguel Acosta

(57) ABSTRACT

A vehicle has a sacrificial buoyancy structure for attenuating damage to the vehicle body due to an under-vehicle explosion. The vehicle has a primary hull, connector plates disposed along the primary hull, track assemblies mounted to the connector plates, and gussets attaching the connector plates to the primary hull. The connection of the gussets to the primary hull is sacrificial in that a sufficient amount of explosive force detaches the gussets, connector plates and track assemblies from the primary hull, whereby the gussets, connector plates and track assemblies absorb a portion of the explosive force. The vehicle further has cross rods disposed between the connector plates and affixed thereto. The vehicle also has a sacrificial buoyancy hull beneath the primary hull attached to the cross members wherein the buoyancy hull, connector plates and primary hull form an enclosed buoyancy compartment enabling the vehicle to float on water.

11 Claims, 3 Drawing Sheets

VEHICLE WITH SACRIFICIAL UNDERBODY STRUCTURE

GOVERNMENT INTEREST

The invention described here may be made, used and licensed by and for the U.S. Government for governmental purposes without paying royalty to us.

BACKGROUND OF THE INVENTION

1. Field of the Invention

In one respect, the invention relates to the art of designing military land vehicles for amphibious operation and particularly relates to the use of enclosed compartments in the land vehicle hull to provide buoyancy for the vehicle. In another respect, the invention relates to the art of armoring underbodies of vehicles to counter explosions under the vehicle from land mines or like munitions. In still a further respect, the invention relates to the use of sacrificial components of a vehicle that are destroyed or blown off the vehicle by a land mine blast so as to absorb energy from the blast.

2. Background Art

U.S. Pat. No. 5,564,984 to Mirabella et al discloses an enclosed buoyancy compartment on the bottom of the vehicle; the Mirabella vehicle may be regarded as amphibious in that it has wheels 106 and 109 that can engage a platform 118. It is also known to employ either a generally V shaped hull on a vehicle to enhance its ability to resist or survive mine blasts or similar explosions occurring under the vehicle. See, for example, U.S. Patent Application Publication 2008/0173167A1 of Mills et al and U.S. Pat. No. 7,997,182 B1 to Cox. U.S. Patent Application Publication 2011/0079978 A1 of Schreiner discusses at paragraph 0004 the possible effects of an under-vehicle explosion on the undercarriage and axle of a vehicle. Schreiner at paragraph 0009 describes side plates under a vehicle which crumple under the force of an explosion so as to absorb blast energy; these side plates also have openings to direct blast force toward the vehicle hull. Additionally, U.S. Pat. No. 5,947,520 to McHorse discloses an elongate sacrificial fairing disposed near a wheel well of a vehicle.

SUMMARY OF THE INVENTION

Our invention is a vehicle having a sacrificial structure for attenuating damage to selected portions of the vehicle and the vehicle's crew due to blast force from an under-vehicle explosion. The sacrificial structure includes elements of the vehicle track and track mounting mechanisms which interconnect and cooperate with elements of a vehicle buoyancy compartment. Our invention is mainly intended for armored vehicles having a typical military vehicle body, though the invention is suitable for other vehicles as well. The vehicle has a primary hull and elongate connector plates disposed along sides of the primary hull to which the vehicle's track assemblies are mounted. The connector plates are affixed to the primary hull by a set of gussets. The connections of the gussets to the primary hull are sacrificial since a sufficiently large blast force detaches the gussets from the primary hull, thereby detaching the connector plates and the track assemblies from the primary hull as well. The detached gussets, connector plates and track assemblies absorb a portion of the blast force that would otherwise affect the primary hull. Cross rods are disposed between the connector plates and affixed thereto. The connection between the cross rod and connector plates can be stronger than the connection between the gussets and the primary hull, whereby the connector plates are tilted outward of the vehicle by a sufficiently large blast force originating under the vehicle. A buoyancy hull beneath the primary hull is attached to the cross members, the connector plates and the primary hull. The buoyancy hull, connector plates and primary hull form an enclosed buoyancy compartment capable of keeping the vehicle afloat in a body of water. The buoyancy hull is more easily shattered than the primary hull and is sacrificed during under-vehicle explosions to absorb force that would otherwise impact the primary hull. Additionally, there are blast relief ports in the connector plates and sacrificial sub plates fitting in the blast relief ports, the sub plates more easily shattered than the primary hull. The connector plates, gussets, track assemblies and cross rods have varied juxtapositions, comprising: a pre-blast juxtaposition wherein the connector plates are generally vertically oriented, the gussets are positioned such that gusset legs are also vertically oriented and the cross rods are straight; a first post-blast configuration wherein the connector plates tilt outward relative to the vehicle, the track assemblies tilt with the connector plates, the gussets tilt with the connector plates and the cross rods are bent by the movement of the gussets; and a second post-blast configuration wherein the gussets, the connector plates, the track assemblies and the cross rods are blown off the vehicle. The gussets, the connector plates and the cross rods form an anti-hop mechanism by redirecting momentum from blast debris during the first post-blast configuration; essentially, the connector plates deflect a portion of the blast force upward relative to the vehicle.

DETAILED DESCRIPTION OF THE PREFERRED EMBODIMENT(S)

Definitions and Terminology

Figure 1:
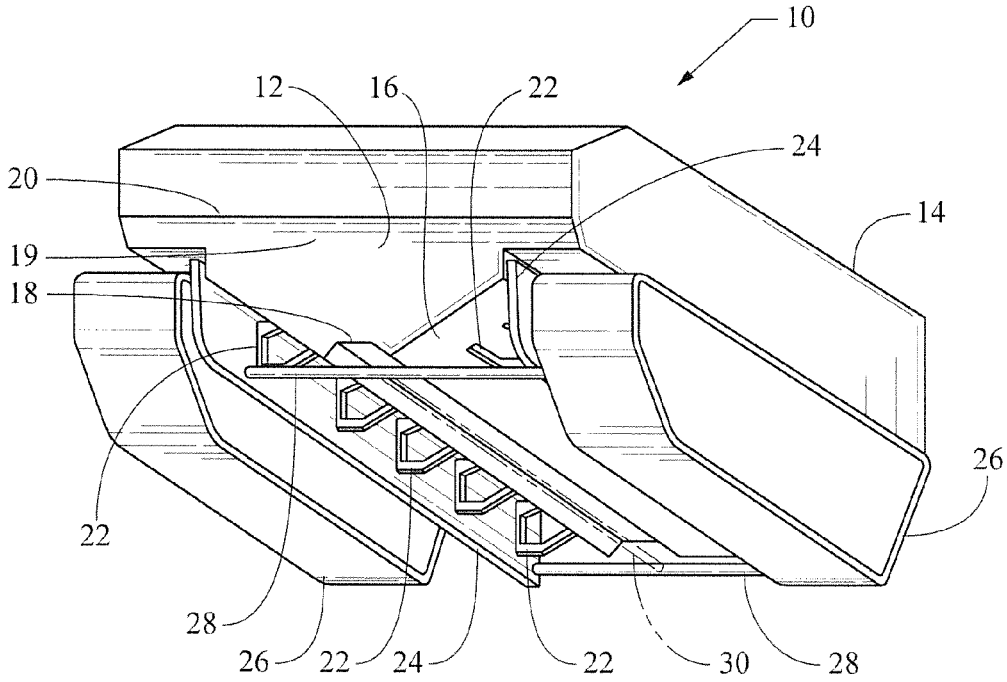
FIG. 1 is a perspective view of a notional tracked military vehicle showing internal elements of the underbody sacrificial structure.

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

For a vehicle, and a system mounted on or used in connection with the vehicle, forward/reverse (longitudinal) and vertical (up/down) directions are generally relative to the vehicle and system as typically operated (e.g., when the vehicle is operated with the respective powertrain in a forward/reverse mode). As such, lateral (left/right) directions are generally perpendicular to the longitudinal/vertical plane, and are referenced from a vehicle operator (e.g., driver) perspective. A first direction (e.g., forward) and a second direction (e.g., rearward or reverse) where the second direction substantially, but not necessarily wholly, opposes the first direction are also generally or used in connection with the vehicle. Likewise, elements located (mounted, positioned, placed, installed, etc.) on, near, or proximate to the vehicle body are generally referred to as "inner", while elements that are distal or more remote to the vehicle body are generally referred to as "outer", unless otherwise noted. As such, inner elements are generally closer to the vehicle body than outer elements. Unless otherwise stated, a vehicle is presumed to be standing on a horizontal surface and vehicle components, such as a body panel or window that are vertically oriented, are disposed normal to the horizontal surface. Likewise, "the vertical" or a "vertical plane" refers to a plane normal to the horizontal surface upon which the vehicle rests.

In FIG. 1 is shown a notional tracked military vehicle 10 incorporating our sacrificial buoyancy hull structure. The vehicle has a primary hull 12 on a conventional tracked vehicle body 14, the hull having a generally V-shaped lateral cross section formed by two oblique panels 16 and an inverted channel 18 therebetween. Fore hull panel 19 of the primary hull encloses the front portion of the hull via seamed edge connections to panels 16, to the fore end of channel 18 and to the interface between body 14 and hull 12 at edge line at 20. An aft primary hull panel (not shown) similarly encloses the aft end of hull 12 via seamed connections to panels 16, the aft end of channel 18 and body 14. The fore hull panel's configuration and interfaces is representative of the configuration and interfaces of the aft hull panel, although these hull panels need not be exactly the same.

Figure 2:
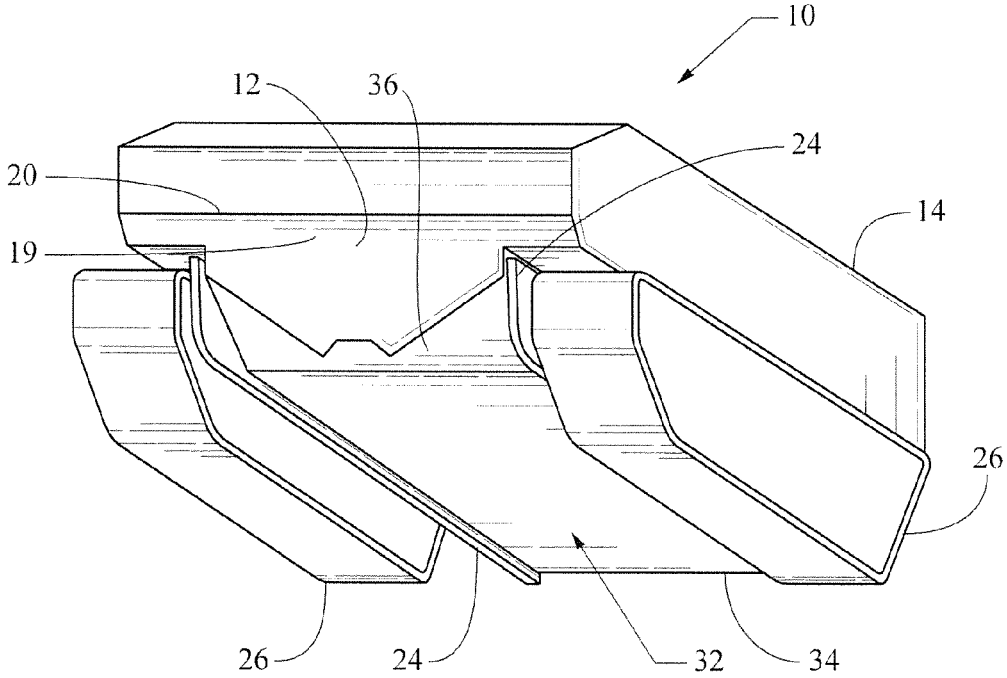
FIG. 2 is a perspective view of a notional tracked military vehicle showing a sacrificial buoyancy hull that covers the internal elements of the underbody sacrificial structure.
Figure 7:
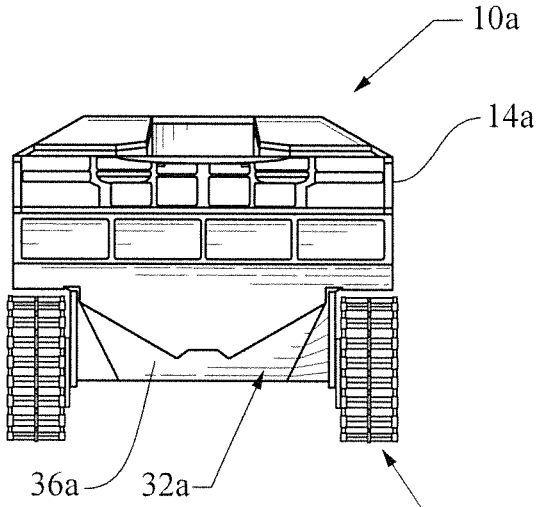
FIG. 7 is a front view of a tracked military vehicle such as that in FIG. 1 but showing more detail of the vehicle body and track assemblies than FIG. 1.
Figure 8:
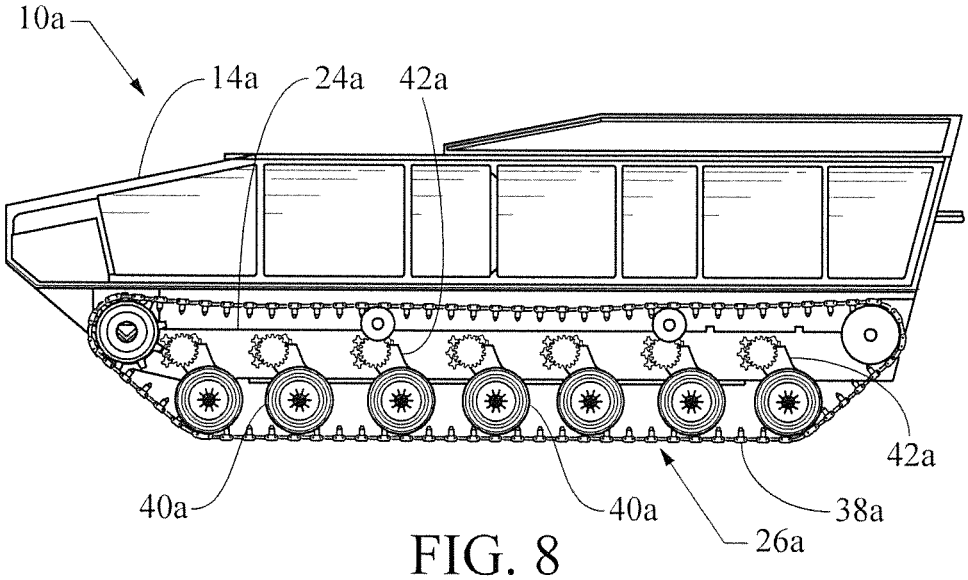
FIG. 8 is a side view of the vehicle in FIG. 8.

A set of gussets 22 are affixed to elongate track connector plates 24, wherein gusset legs 48 (FIG. 3) fit against and connect to the inboard sides of the connector plates. Gussets 22 are affixed to panels 16 so that the gussets are the means by which connector plates are attached to oblique panels 16 and primary hull 12. Conventional track assemblies 26 are mounted to plates 24. A more detailed view of a conventional 165 track assembly is shown at reference numeral 26*a* in FIGS. 7 and 8. Affixed to and connected between connector plates 24 are transverse cross rods 28 disposed near the fore and aft ends of the connector plates. Optionally, as shown in phantom lines, a longitudinal rod 30 can be affixed between cross rods 28 so that all the rods together form an I-shaped frame. In FIG. 2 vehicle 10 is shown with a buoyancy hull 32 disposed beneath main hull 12. FIGS. 7 and 8 show what is essentially the same as vehicle 10, but with more detail of the vehicle body and track assemblies being presented. The numbering scheme for FIGS. 7 and 8 is analogous to in FIGS. 1 and 2, in that the reference numerals for FIGS. 7 and 8 have an "a" suffix for elements corresponding to those in FIGS. 1 and 2.

Returning to FIG. 2, the two hulls 12 and 32 form with connector plates 24 an air-filled buoyancy compartment that keeps vehicle 10 afloat as it fords or travels over a body of water, the compartment preferably being watertight or very nearly so. Buoyancy hull 32 is comprised of a bottom buoyancy plate 34 affixed to cross rods 28 and is plate 34 is also affixed to longitudinal rod 30 if the longitudinal rod is utilized on vehicle 10. The buoyancy hull also comprises a fore buoyancy plate 36 attached to and fitting with fore panel 19, bottom plate 32 and connector plates 24. Similar to fore buoyancy plate 36 (but not shown) is an aft buoyancy plate attached to and fitting with the aft primary hull panel, bottom buoyancy plate 34 and connector plates 24, wherein the fore buoyancy plate's configuration and interfaces are representative of the configuration and interfaces of the aft buoyancy plate.

Preferably, the buoyancy hull plates are formed of material that shatters or is pulverized when a sufficient blast force occurs under vehicle 10, so that the buoyancy hull's shattering or pulverizing absorbs some of this blast force before it impacts primary hull 12. Preferably too, buoyancy hull 32 covers the primary hull's bottom from beneath 190 and the buoyancy hull is constructed of relatively weaker and more frangible material than are primary hull 12 and connector plates 24.

Figure 3:
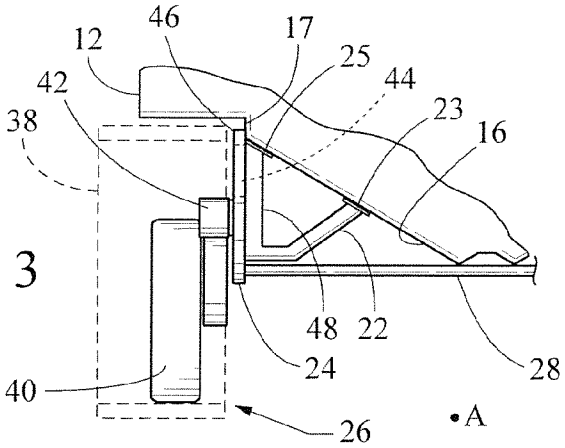
FIG. 3 is a front view of the underbody sacrificial structure showing details of a track assembly as mounted to the notional military vehicle.
Figure 4:
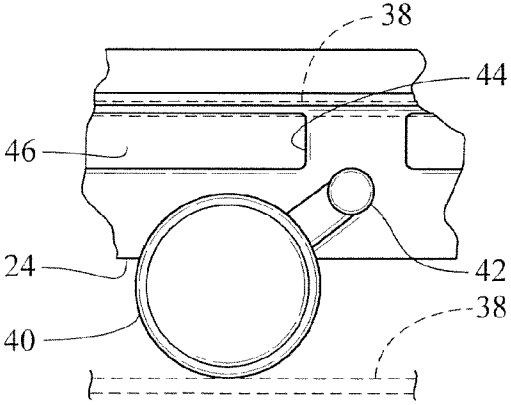
FIG. 4 is a side view of the track assembly and mounting components of FIG. 3

FIGS. 3 and 4 show how track assembly 26 is mounted to vehicle 10, the buoyancy hull being omitted for purposes of illustration. In those figures the track is represented in dashed lines at 38 whereas a road wheel of the track assembly is shown at 40. Road wheel 40 is attached to conventional suspension arm 42 which in turn is pivotally connected to connector plate 24. Analogs of track 38, road wheel 40, pivot arm 42 and connector plate 24 are shown in FIG. 8 at respective reference numerals 38*a*, 40*a*, 42*a* and 24*a*. As noted previously, connector plates are affixed by gussets 22 to oblique hull panels 16 of the primary hull via gusset legs 48.

The connection of gussets 22 to panels 16 may be regarded as a sacrificial connection since gussets 22 will detach from panels 16 if sufficient blast force results from an explosion beneath vehicle 10. Thus connector plates and track assemblies 26 will fly off vehicle 10 when relatively powerful explosions occur under the vehicle. The track assembles and connector plates will thereby absorb a portion of the blast energy from the explosion and prevent that portion of the blast energy from affecting primary hull 12, the rest of vehicle 10 and the soldiers or crew occupying vehicle 10. The connector plates have blast relief ports 44 in which are fit window-like sub plates 46, which can be made of the same material as the buoyancy plate, preferably such that sub plates 46 shatter before oblique panels 16 or connector plates 24 are significantly damaged. The shattering of sub plates 46 absorbs energy from an under-vehicle explosion that would otherwise be imparted to oblique panels 16, connector plates 24 or track assembly 26.

Figure 5:
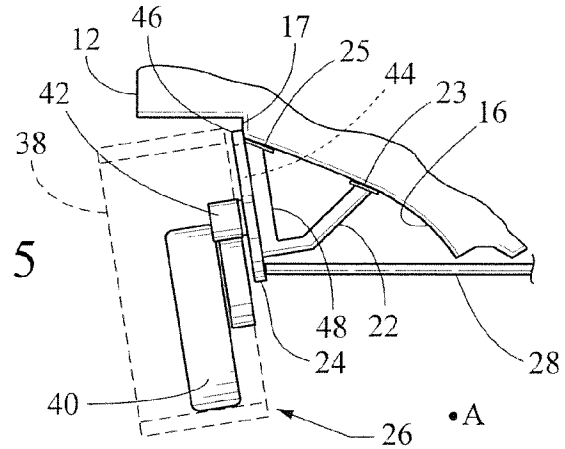
FIGS. 5 and 6 show the track assembly and mounting components of FIG. 3 as these components move or deform during an under-vehicle explosion.

The connection of cross rods 28 to connector plates 24 may be stronger than the connection gussets 22 to oblique panels 16 of primary hull 12. In this case, if an under-vehicle explosion occurs, gussets 22 will detach from oblique panels 16 before connector plates detach from cross rods 28. For this reason, during such an explosion, connector plates 24, gussets 22 and track assembly 26 begin to be tilted outward by the explosion as shown in FIG. 5. As shown in exaggerated fashion in FIGS. 5 and 6, the tilting of gusset plates 22 will bend oblique panels 16 slightly in an inner zone where inboard gusset anchor elements 23 contact these panels. On the other hand, outboard anchor elements 25 of gussets 22 contact another, outer zone of oblique panels 16 where edges of the oblique panels form a cross-sectionally Z-shaped region of primary hull 12. Consequently, the outer zone where anchor element 25 attaches is more rigid than the inner zone where anchor element 23 attaches. Anchor elements 25 tend to detach from oblique panels 16 before anchor elements 23, since oblique panels 16 move more in concert with anchor elements 23 than with anchor elements 25, whereby anchor elements 23 maintain contact with oblique panels 16 after anchor element 25 detaches from panels 16 and gusset 22 tilts outward.

Figure 6:
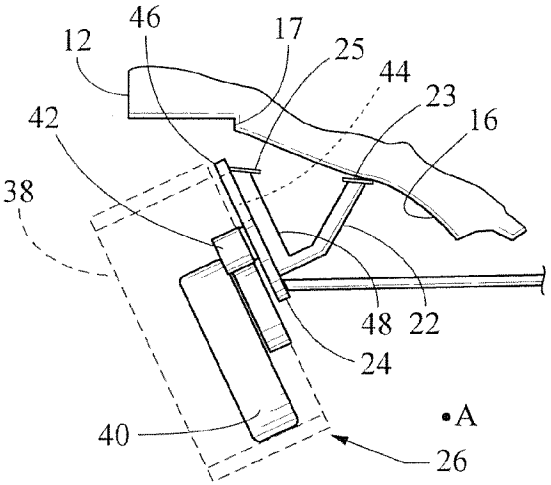

The tilting continues as shown in FIG. 6, where gussets 22 are breaking away from oblique panels 16. The tilting of connector plates 24 exerts a bending force on cross rods 28 so that these rods are strained and ultimately absorb force via deformation in addition to the force absorbed by the connector plates and track assemblies. Cross rods 28 may thus be regarded as tri-functional: these rods are part of a frame supporting bottom buoyancy plate 34, fore buoyancy plate 36 and the aft buoyancy plate; they facilitate tilting of connector plates 24 during and under-vehicle explosion; and they deform during an explosion to absorb some of the energy thereof.

For a time, while anchor element 23 is still connected to oblique panel 16, the tilting of connector plate 24 during an under-vehicle explosion has a desirable anti-hop effect on vehicle 10. Hop, as that term is used here, refers to the rapid upward acceleration of a vehicle occurring when land mines or like munitions explode under a vehicle. The sudden upward acceleration, or hop, can cause severe injuries to vehicle crew members, particularly to the crew's spinal columns. For purposes of describing the anti-hop effect, let it be assumed that a mine or IED (improvised explosive device) detonates at point A in FIGS. 3 through 5 and produces a generally hemispherical expanding shock wave front as is typical for such munitions. Accompanying the shock wave is a hemispherical, expanding body of debris containing flying soil, rock and other material. When the debris strikes the outwardly tilted connector plate 24, some momentum from the debris is transferred to connector plate 24 and track assembly 26, the transferred momentum having a vertically downward component. For the time while connector plates 24 and track assembly 26 are still connected to vehicle 10, the downward component of the transferred momentum will inhibit the upward rise, or hop, of vehicle 10. Likewise the shock wave will act on connector plate 24, and when plate 24 is tilted outward, the shock wave causes a downward force on plate 24 and track assembly 26 and thus causes a downward force on vehicle 10. Some portion of the debris and shock wave impacting connector plate 24 may be deflected toward and impact a lower, ground-facing surface of primary hull 12; but this deflected portion of the debris and shock wave will now be more distant from point A and will therefore exert less pressure than when striking connector plate 24. Additionally the debris will have already lost momentum to connector 24 and track assembly 26. Thus the deflected portion of the debris and shock creates a net downward force on vehicle 10.

From an overall perspective, vehicle 10 has a staged, progressive use of sacrificial components that attenuate the effect of under-vehicle explosions on primary hull 10 and the vehicle crew members. For relatively smaller explosions, only the buoyancy panels are damaged or destroyed. For somewhat larger explosions, both the buoyancy panels and sub plates 46 of the connector plates would be damaged or destroyed, and blast force or blast debris will pass through blast relief ports 44 in a generally horizontal outboard direction. For the largest explosions, not only would the buoyancy plates and the aforementioned sub plates be damaged or destroyed, but also the connector plates and track assemblies 26 would be blown off the vehicle.

Gussets 22, connector plates 24, track assemblies 26 and cross rods 28 have differing juxtapositions relative to vehicle 10. In the first juxtaposition, as exemplified by the pre-blast condition in FIG. 3, connector plates 24 are generally vertically oriented and lie in a vertical plane parallel to the longitudinal axis of vehicle 10. Gussets 22 are oriented such that gusset legs 48 are also generally vertically oriented; cross rods 28 are straight, as opposed to being bent or twisted under the influence of an explosion from point A. The second configuration is a first post-blast condition exemplified by FIG. 5 wherein connector plates 24 have begun to tilt outward relative to vehicle 10 and track assemblies 26 tilt with the connector plates. Gussets 22 rotate slightly so as to move with connector plates 24 and cross rods 28 are bent by the movement of gussets 22. Gussets 22 remain at least partly attached to oblique panels 16 in that anchor elements 23 will not be completely detached from panels 16 even if anchor elements 25 have completely separated from panels 16. The third configuration is the second post blast condition wherein gussets 22, connector plates 24, track assemblies 26 and cross rods 28 have been blown off vehicle 10.

Various alterations and modifications will become apparent to those skilled in the art without departing from the scope and spirit of this invention and it is understood this invention is limited only by the following claims.

What is claimed is:

1. A vehicle having a sacrificial buoyancy structure for attenuating damage to selected portions of the vehicle due to blast force from an under-vehicle explosion, the vehicle comprising:

a vehicle body;

a primary hull of the vehicle;

connector plates disposed along sides of the primary hull;

track assemblies mounted to the connector plates;

gussets attached to the connector plates;

a sacrificial connection of the gussets to the primary hull such that a sufficient amount of the blast force detaches the gussets, connector plates and track assemblies from the primary hull, whereby the gussets, connector plates and track assemblies absorb a portion of the blast force;

cross rods disposed between the connector plates and affixed thereto; and a buoyancy hull beneath the primary hull attached to the cross members, the connector plates and the primary hull such that the buoyancy hull, the connector plates and the primary hull form an enclosed compartment.

2. The vehicle of claim 1, wherein the connector plates, gussets, track assemblies and cross rods have varied juxtapositions, comprising:

a pre-blast juxtaposition wherein the connector plates are generally vertically oriented, the gussets are positioned such that gusset legs are also generally vertically oriented;

a first post-blast configuration wherein the connector plates tilt outward relative to the vehicle while the gussets are at least partly attached to the primary hull; and a second post-blast configuration wherein the gussets, the connector plates, the track assemblies and the cross rods are blown off the vehicle.

3. The vehicle of claim 2 wherein the gussets, the connector plates and the cross rods form an anti-hop mechanism during the first post-blast configuration.

4. The vehicle of claim 1, further comprising:

first anchor elements of the gussets connecting the gussets to a first zone of the primary hull;

second anchor elements of the gussets connecting the gussets to a second zone of the primary hull;

wherein the first zone of the primary hull is more outboard of the vehicle than the second zone and the second zone is more flexible than the primary zone.

5. A vehicle having a sacrificial buoyancy structure for attenuating damage to selected portions of the vehicle due to blast force from an under-vehicle explosion, the vehicle comprising:

a vehicle body;

a primary hull of the vehicle;

connector plates disposed along sides of the primary hull;

track assemblies mounted to the connector plates;

gussets attached to the connector plates;

a sacrificial connection of the gussets to the primary hull such that a sufficient amount of the blast force detaches the gussets, connector plates and track assemblies from the primary hull, whereby the gussets, connector plates and track assemblies absorb a portion of the blast force;

cross rods disposed between the connector plates and affixed thereto, wherein a connection between the cross rod and connector plates is stronger than the connection between the gussets and the primary hull, whereby the connector plates are tilted outward of the vehicle by the sufficient amount of the blast force;

a buoyancy hull beneath the primary hull attached to the cross members, the connector plates and the primary hull such that the buoyancy hull, the connector plates and the primary hull form an enclosed buoyancy compartment capable of keeping the vehicle afloat in a body of water, the buoyancy hull more easily shattered than the primary hull;

blast relief ports in the connector plates; and sub plates fitting in the blast relief ports, the sub plates more easily shattered than the primary hull.

6. The vehicle of claim 5, wherein the connector plates, gussets, track assemblies and cross rods have varied juxtapositions, comprising:

a pre-blast juxtaposition wherein the connector plates are vertically oriented the gussets are positioned such that gusset legs are also vertically oriented and the cross rods are straight;

a first post-blast configuration wherein the connector plates tilt outward relative to the vehicle, the track assemblies tilt with the connector plates, the gussets tilt with the connector plates and the cross rods are bent by the movement of the gussets; and a second post-blast configuration wherein the gussets, the connector plates, the track assemblies and the cross rods are blown off the vehicle.

7. The vehicle of claim 6 wherein the gussets, the connector plates and the cross rods form an anti-hop mechanism during the first post-blast configuration, the connector plates deflecting a portion of the blast force upward relative to the vehicle.

8. The vehicle of claim 7, further comprising:

first anchor elements of the gussets connecting the gussets to a first zone of the primary hull;

second anchor elements of the gussets connecting the gussets to a second zone of the primary hull, the second zone having a Z shaped cross section;

wherein the first zone of the primary hull is more outboard of the vehicle than the second zone and the second zone is more flexible than the primary zone.

9. A vehicle having a sacrificial buoyancy structure for attenuating damage to selected portions of the vehicle due to blast force from an under-vehicle explosion, the vehicle comprising:

a vehicle body;

a primary hull of the vehicle;

elongate connector plates disposed along sides of the primary hull;

track assemblies mounted to the connector plates;

gussets having first anchor elements connecting the gussets to a first zone of the primary hull, the gussets having second anchor elements connecting the gussets to a second zone of the primary hull, the first zone having a Z shaped cross section;

wherein the first zone of the primary hull is more outboard of the vehicle than the second zone and the second zone is more flexible than the primary zone sacrificial connections of the anchor elements to the primary hull such that a sufficient amount of the blast force detaches the second anchor elements from the primary hull before the first anchor elements;

wherein the sufficient amount of the blast force also detaches the connector plates and the track assemblies from the primary hull, whereby the gussets, connector plates and track assemblies absorb a portion of the blast force that would otherwise affect the primary hull;

cross rods disposed between the connector plates and affixed thereto, wherein a connection between the cross rod and connector plates is stronger than the sacrificial connections between the gussets and the primary hull, whereby the connector plates are tilted outboard of the vehicle by the sufficient amount of the blast force;

a buoyancy hull beneath and covering a bottom of the primary hull, the buoyancy hull attached to the cross members, the connector plates and the primary hull such that the buoyancy hull, the connector plates and the primary hull form an enclosed buoyancy compartment capable of keeping the vehicle afloat in a body of water, the buoyancy hull more easily shattered than the primary hull;

blast relief ports in the connector plates; and sub plates fitting in the blast relief ports, the sub plates more easily shattered than the primary hull.

10. The vehicle of claim 9, wherein the connector plates, gussets, track assemblies and cross rods have varied juxtapositions, comprising:

a pre-blast juxtaposition wherein the connector plates are vertically oriented and lie in a vertical plane parallel to a longitudinal axis of the vehicle, the gussets are positioned such that gusset legs are also vertically oriented and the cross rods are straight;

a first post-blast configuration wherein the connector plates tilt outward relative to the vehicle, the track assemblies tilt with the connector plates, the gussets tilt with the connector plates and the cross rods are bent by the movement of the gussets; and a second post-blast configuration wherein the gussets, the connector plates, the track assemblies and the cross rods are blown off the vehicle.

11. The vehicle of claim 10 wherein the gussets, the connector plates and the cross rods form an anti-hop mechanism taking momentum from blast debris during the first post-blast configuration, the connector plates then deflecting a portion of the blast force upward relative to the vehicle.

* * * * *